United States Patent [19]

Telmo

[11] 4,423,683

[45] Jan. 3, 1984

[54] ENCLOSURE FOR A WARHEAD CASE

[75] Inventor: Frisco T. Telmo, King George, Va.

[73] Assignee: The United States of America as represented by the Secretary of the Navy, Washington, D.C.

[21] Appl. No.: 334,753

[22] Filed: Dec. 28, 1981

[51] Int. Cl.[3] ..... F42B 13/48; B65D 25/00

[52] U.S. Cl. ..... 102/481; 220/89 A

[58] Field of Search ..... 102/481, 390, 334, 367, 102/368, 369; 220/89 A; 150/52 H

[56] References Cited

U.S. PATENT DOCUMENTS

| | | | |
|---|---|---|---|
| 1,434,784 | 11/1922 | Lucas | 102/334 |
| 2,487,104 | 11/1949 | Cooper | 220/89 A |
| 3,665,857 | 5/1972 | Radnich et al. | 102/1 R |
| 3,992,997 | 11/1976 | McCubbin et al. | 102/56 |

*Primary Examiner*—Charles T. Jordan
*Assistant Examiner*—Ted L. Parr
*Attorney, Agent, or Firm*—R. F. Beers; K. E. Walden; W. R. Henderson

[57] ABSTRACT

An enclosure for a warhead case which prevents a high order detonation of the warhead due to inadvertent initiation from physical, bullet, fragment impact, fire exposure or other factors causing a pressure buildup in the case. The warhead explosive is assembled in a hollow cylindrical warhead case having an open end and a closed end. An enclosure plate is positioned in the open end to close off the warhead in the case. The enclosure is circular and provided with a first plurality of radially extending apertures. The warhead case is provided with a second plurality of radially extending apertures which are positioned to coincide with the aperture in the enclosure plate. A plurality of pins are press fit into the case apertures so as to extend into the enclosure plate apertures and attach the enclosure plate to the warhead case. The pins are intended to fail structurally when the internal pressure of the warhead case reaches a predetermined threshold so as to remove the enclosure plate and relieve any pressure buildup that may cause a high order detonation of the warhead.

5 Claims, 3 Drawing Figures

FIG. 1
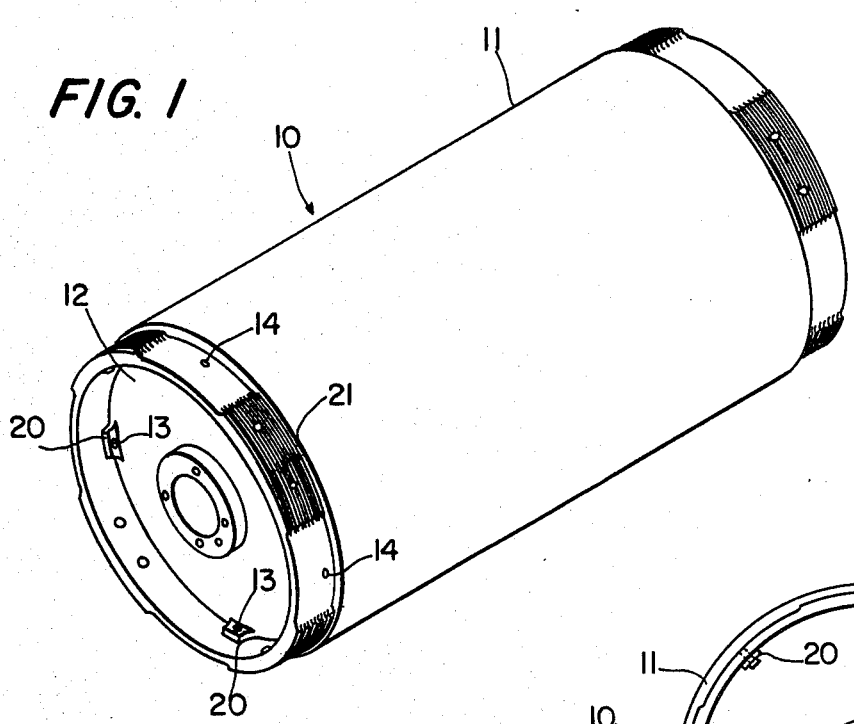
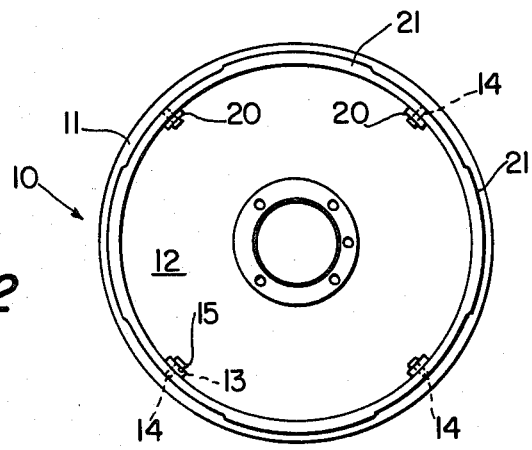
FIG. 2
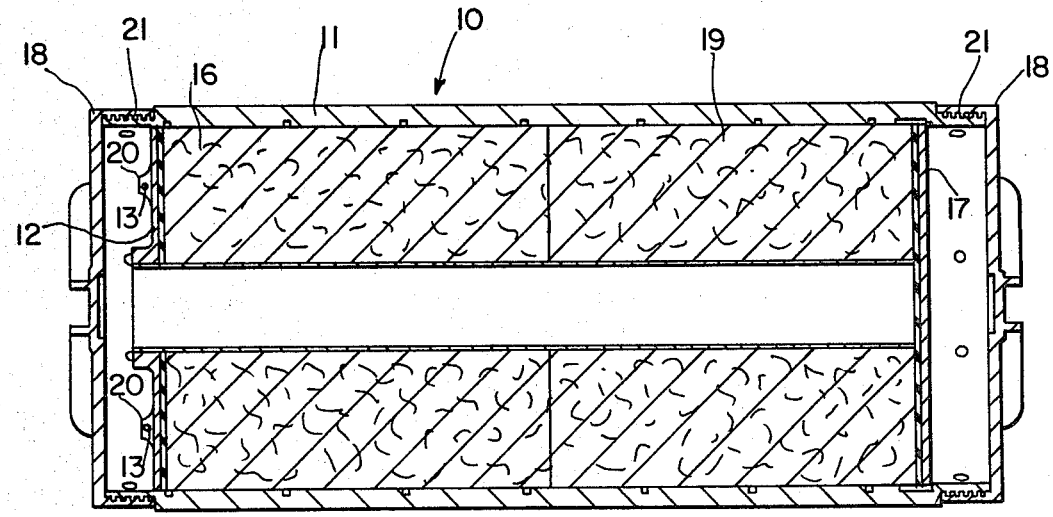
FIG. 3

ENCLOSURE FOR A WARHEAD CASE

BACKGROUND OF THE INVENTION

The present invention relates to an enclosure for a warhead case and more particularly to an enclosure which prevents high order detonation of the warehead due to inadvertent initiation caused by impact, fire exposure, or other factors resulting in a pressure buildup in the warhead case.

One of the more difficult problems associated with warhead safety is the problem resulting from the possibility that a warhead may be subjected to physical impact or high degrees of thermal radiation during transportation or storage causing a pressure buildup within the warhead case and subsequent detonation of the warhead.

Prior art devices for preventing such inadvertent detonation encompass the warhead casing of McCubbin et al, disclosed in U.S. Pat. No. 3,992,997. The casing of McCubbin et al is designed to protect the high explosive warhead from open fires or other sources of intense heat which might cause premature detonation of the warhead. The warhead casing is relieved throughout the greater part of its circumference with the relieved area filled with an ablative material covered by a protective intumescent coating of fire resistant impregnated cloth.

Another warhead safety device is disclosed in U.S. Pat. No. 3,665,857, to Radnich et al, which discloses a safety lifting plug for a projectile. When a projectile provided with the safety lifting plug is exposed to high environmental temperatures, thereby creating a possibility of a high order detonation, the sealing material of the safety plug melts thereby communicating the interior of the projectile with the atmosphere so as to allow the explosive charge gases to escape thus relieving pressure buildup within the projectile.

The disadvantage of both the McCubbin et al and Radnich et al devices is that both devices require that additional structure be incorporated into the warhead to perform the desired safety function. The enclosure of the subject invention can be incorporated in existing warhead cases without the necessity of additional parts and structure and a corresponding increase in the weight of the warhead.

SUMMARY OF THE INVENTION

Accordingly, there is provided in the present invention an enclosure for a warhead case which prevents a high order detonation of the warhead due to inadvertent initiation from physical impact, bullet or fragment impact, fire exposure or other factors causing a pressure buildup in the warhead case.

The warhead explosive is assembled in a hollow cylindrical warhead case having an open end and a closed end. An enclosure plate is positioned in the open end to close off the warhead explosive in the case. The enclosure is circular and provided with a first plurality of radially extending apertures positioned circumferentially on the enclosure plate.

The warhead case is provided with a second plurality of radially extending apertures which are positioned on the case so as to coincide with the first plurality of apertures in the enclosure plate. A plurality of chamfered cylindrical pins are press fit into the warhead case apertures so as to extend into the enclosure plate apertures and attach the enclosure plate to the warhead case. The pins are intended to fail structurally when the internal pressure of the warhead case reaches a predetermined threshold pressure so as to allow removal of the enclosure plate by axial displacement to relieve pressure buildup and prevent a high order detonation of the warhead.

OBJECTS OF THE INVENTION

It is an object of the present invention to provide an enclosure plate for a warhead case which prevents high order detonation of the warhead due to pressure buildup in the warhead case.

Another object of the invention is to provide an enclosure for a warhead case which is inexpensive to manufacture and simple in design.

A further object of the present invention is to provide an enclosure for a warhead case which reduces pressure buildup in the warhead due to accidental initiation of the explosive material.

A still further object of the present invention is to provide an enclosure for a warhead case which prevents pressure buildup in the warhead due to physical, bullet, fragment, impact, fire exposure or other factors.

Other objects, advantages, and novel features of the present invention will become apparent from the following detailed description of the invention when considered in conjunction with the drawings.

BRIEF DESCRIPTION OF THE DRAWINGS

A more complete appreciation of the invention and many of the attendant advantages thereof will be readily understood by reference to the following detailed description when considered with the accompanying drawings in which like reference numerals designate like parts throughout the figures and wherein:

FIG. 1 illustrates an isometric view of a warhead case incorporating the enclosure of the subject invention;

FIG. 2 illustrates an end view of the warhead case illustrated in FIG. 1; and FIG. 3 illustrates a side view in cross-section of the warhead case of FIG. 1.

DESCRIPTION OF THE PREFERRED EMBODIMENT

Referring to FIG. 1, there is illustrated a warhead case 10 which is of the type suitable for containing high explosive material. Case 10 is constructed as a hollow cylinder 11 having closed end 17 and open end 16, illustrated in FIG. 3.

Referring to FIG. 3, case 10 encompasses high explosive material 19 which is positioned between closed end 17 and open end 16 of the warhead case.

Open end 16 is provided with a circular enclosure plate 12 which is positioned in open end 16 so as to close off the warhead case and encompass explosive material 19.

As illustrated in FIGS. 1 through 3, enclosure plate 12 is provided with a plurality of aperture elements 20 which extend axially from the outward facing surface of the enclosure plate. The plurality of aperture elements 20 are positioned circumferentially on the outward face of enclosure plate 12. Each aperture element 20 is furnished with an aperture 13 which extends radially inward with respect to enclosure plate 12. As better shown by FIG. 2, aperture elements 20 are positioned circumferentially with equal spacing on enclosure plate 12. Although FIG. 2 illustrates the enclosure plate as being provided with 4 aperture elements, it is to be understood that any suitable number of elements may be provided as may best be determined by the particular application.

As illustrated in FIGS. 1 and 2, the open end of case 11 is provided with a plurality of apertures 14 which are positioned circumferentially on open end 16 so as to extend radially inward and coincide with the apertures 13 of aperture elements 20. Press fit into each of the case apertures 14 is a chamfered, cylindrical pin 15, shown in FIG. 2, which extends through each of the apertures 14 and into the corresponding enclosure plate aperture 13 so as to attach enclosure plate 12 to the open end of warhead case 11.

Pins 15 may be machined or otherwise constructed from a material such as annealed mild steel, for example, with a 15° chamfer on one end to facilitate the insertion of the pins into apertures 14 and 13. The pins are intended to fail structurally at a predetermined threshold pressure, such as 200 p.s.i., for example, and thus relieve any pressure buildup in the warhead case caused by fire, physical, bullet, fragment impact, or other factors which may cause pressure buildup in the case.

Referring to FIG. 3, it can be seen that both open end 16 and closed end 17 of case 11 are provided with outer container covers 18 which are affixed to case 11 by interrupted Acme threads 21, also illustrated in FIG. 1. The interrupted threading on case 11 receives complementary interrupted female acme threading provided on outer container covers 18. This allows quick connect and disconnect of the covers from case 11. As illustrated in FIG. 3, the outer ends of case 11 are provided with a plurality of holes (not numbered) for bleeding of pressure. Also, as shown in FIG. 3, the ends of outer container covers 18 are spaced outwardly some distance from the cylinder ends and from the circular plates. This provides a space for allowing contained displacements of at least one of the circular plates after its shear pins are sheared due to pressure buildup.

It is thus apparent that the disclosed enclosure for a warhead case provides a means for relieving internal pressure buildup in the warhead case so as to avoid inadvertent detonation of the warhead. The enclosure is simple in design and inexpensive to manufacture and minimizes the additional weight increase of the warhead.

Many obvious modifications and embodiments of the specific invention other than those set forth above will readily come to mind to one skilled in the art having the benefit of the teaching presented in the foregoing description and the accompanying drawings of the subject invention, and hence it is to be understood that such modifications are included within the scope of the appended claims.

What is claimed as new and desired to be secured by Letters Patent of the United States is:

1. An enclosure for an explosive to prevent inadvertent detonation thereof due to enclosure pressure buildup, comprising:

a hollow cylinder containing explosive material;

first circular plate means secured within one end of the hollow cylinder for closing it;

second circular plate means slidably disposed within the other end of the hollow cylinder for defining a temporary closure;

circumferentially spaced, radially directed apertures aligned between the second circular plate and hollow cylinder;

shear pins disposed in the aligned apertures for retaining the second circular plate within the hollow cylinder;

said shear pins adapted for failure at elevated pressure buildup in the contained explosive for allowing the second circular plate to be displaced in the axial direction from the hollow cylinder other end for relieving said pressure buildup; and outer container covers releasibly secured to the outer ends of the hollow cylinder and including a portion spaced outwardly of the circular plates means to define a space for allowing contained displacement of at least the second circular plate means due to pressure buildup in the hollow cylinder having sheared the shear pins.

2. The invention according to claim 1 further defined by additional holes disposed in the wall of the hollow cylinder outward of the circular plate means for bleeding relieved pressure to the atmosphere.

3. The invention according to claim 1 further defined by threading on the outer container covers and the hollow cylinder ends for releasibly securing the outer container covers in position.

4. The invention according to claim 2 further defined by cooperative threading on the outer container covers and the hollow cylinder ends for releasibly securing the outer container covers in position.

5. The invention according to claim 4 further defined by the threading being interrupted threading for providing quick disconnect.

* * * * *